US005616013A

United States Patent [19]

Kobayashi et al.

[11] Patent Number: 5,616,013

[45] Date of Patent: Apr. 1, 1997

[54] FULL-CIRCUMFERENTIAL FLOW PUMP

[75] Inventors: Makoto Kobayashi; Masakazu Yamamoto; Yoshio Miyake; Koji Isemoto; Keita Uwai; Yoshiaki Miyazaki, all of Fujisawa, Japan

[73] Assignee: Ebara Corporation, Tokyo, Japan

[21] Appl. No.: 562,155

[22] Filed: Nov. 22, 1995

[30] Foreign Application Priority Data

Nov. 25, 1994 [JP] Japan ..... 6-315894

[51] Int. Cl.[6] ..... F04B 17/03

[52] U.S. Cl. ..... 417/423.14; 417/423.11; 415/182.1

[58] Field of Search ..... 417/366, 423.8, 417/423.9, 423.11, 423.14; 415/215.1, 108, 182.1, 214.1

[56] References Cited

U.S. PATENT DOCUMENTS

| | | | |
|---|---|---|---|
| 4,172,695 | 10/1979 | Uesugi | 417/424 |
| 5,358,380 | 10/1994 | Arakawa | 415/215.1 |
| 5,385,444 | 1/1995 | Kobayashi et al. | 415/182.1 |
| 5,388,971 | 2/1995 | Kobayashi et al. | 417/423.14 |
| 5,401,146 | 3/1995 | Moriya et al. | 417/423.14 |
| 5,478,215 | 12/1995 | Kobayashi et al. | 417/423.14 |
| 5,494,403 | 2/1996 | Kobayashi et al. | 415/182.1 |
| 5,494,418 | 2/1996 | Moriya et al. | 417/423.14 |

OTHER PUBLICATIONS

U.S. Application Serial No. 08/275,528 filed Jul. 15, 1994.
U.S. Application Serial No. 08/322,425 filed Oct. 13, 1994.
U.S. Application Serial No. 08/354,818 filed Dec. 8, 1994.
U.S. Application Serial No. 08/364,684 filed Dec. 28, 1994.
U.S. Application Serial No. 08/530,909 filed Sep. 20, 1995.
U.S. Application Serial No. 08/562,155 filed Nov. 22, 1995.
U.S. Application Serial No. 08/578,896 filed Dec. 27, 1995.
U.S. Patent Application Serial No. 08/598,651, filed Feb. 8, 1996, still pending.
U.S. Patent Application Serial No. 08/607,264, filed Feb. 21, 1996, still pending.

*Primary Examiner*—Timothy Thorpe
*Assistant Examiner*—Peter G. Korytnyk
*Attorney, Agent, or Firm*—Oblon, Spivak, McClelland, Maier & Neustadt, P.C.

[57] ABSTRACT

A full-circumferential flow pump includes a motor having a stator, a shaft rotatably disposed in the stator, and a rotor mounted on the shaft for rotation relative to the stator, an outer frame barrel disposed around the stator, an outer cylindrical pump casing disposed around the outer frame barrel with an annular space defined therebetween, and a pump assembly mounted on an end of the shaft for pumping a fluid into the annular space or pumping a fluid introduced from the annular space. The full-circumferential flow pump further includes an inner casing provided in the outer cylindrical pump casing for accommodating the impeller and a resilient seal disposed between the outer cylindrical pump casing and the inner casing for preventing a pumped fluid in the outer cylindrical pump casing from leaking towards a suction side of the impeller.

14 Claims, 4 Drawing Sheets

FULL-CIRCUMFERENTIAL FLOW PUMP

BACKGROUND OF THE INVENTION

1. Field of the Invention

The present invention relates to a full-circumferential flow pump and, more particularly, to a full-circumferential flow pump which has a motor, an outer cylindrical pump casing enclosing the motor, and an annular space formed between a motor frame barrel provided around a stator of the motor and the outer cylindrical pump casing.

2. Description of the Related Art

It has been customary to press sheet steel such as stainless steel to form a pump casing according to a deep drawing process, and then weld or otherwise fasten a suction or discharge flange to the pressed pump casing. The pump casing thus fabricated is liable to be deformed due to the internal pressure developed in the pump casing itself and also external forces applied to the pump casing from piping connected thereto. Any deformation that the pump casing suffers should be reduced to such a level that the pump casing will never be in contact with an impeller housed in the pump casing. Therefore, the pressed pump casing must meet mechanical strength requirements for bearing loads including external forces applied from the connected piping and internal pressure developed in the pump casing, and also rigidity requirements for maintaining a desired clearance between a liner ring and the impeller.

Inasmuch as the pressed pump casing is of a relatively flexible structure with respect to applied loads, it is impossible for the pressed pump casing itself to satisfy both the mechanical strength requirements and the rigidity requirements. To achieve a desired level of rigidity, conventional pressed pump casings have employed a steel sheet having a thickness greater than the thickness required to withstand an internal pressure developed therein, or a reinforcing member of complex shape attached thereto.

As described above, conventionally, in order to prevent the pump casing or the liner portion thereof from being deformed, the rigidity of the pump casing has been increased by employing either a steel sheet having a thickness greater than the thickness required to withstand an internal pressure developed in the pump casing or a reinforcing member of complex shape attached thereto. The steel sheet of increased thickness is, however, difficult to press to shape, and the reinforcing member of complex shape results in an increase in the cost of manufacture of the pump casing.

SUMMARY OF THE INVENTION

It is therefore an object of the present invention to provide a full-circumferential flow pump having a pump casing which has a liner portion which is prevented from being deformed, and which is made of a metal sheet having a thickness not greater than that necessary to withstand external forces applied to the pump casing and an internal pressure developed in the pump casing, and which has no reinforcing member for reinforcing the pump casing.

According to an aspect of the present invention, there is provided a full-circumferential flow pump comprising: a motor having a stator, a rotor mounted on a shaft and disposed in the stator for rotation relative to the stator and an outer frame barrel enclosing the stator; an outer cylindrical pump casing disposed around the outer frame barrel with an annular space defined therebetween; a pump assembly having at least one impeller mounted on an end of the shaft for pumping a fluid into the annular space or pumping a fluid from the annular space; an inner casing provided in the outer cylindrical pump casing for accommodating the impeller; and a resilient seal disposed between the outer cylindrical pump casing and the inner casing for preventing a pumped fluid in the outer cylindrical pump casing from leaking towards a suction side of the impeller.

According to the present invention, the inner casing is housed in the outer cylindrical pump casing and spaced therefrom by the resilient seal interposed between the inner casing and the outer cylindrical pump casing. The resilient seal is effective to absorb deformations of the outer cylindrical pump casing due to external forces applied thereto. Hence, such deformations of the outer cylindrical pump casing are not transmitted to the inner casing. The inner casing is thus prevented from being deformed under pressure. Since the outer cylindrical pump casing is not required to be excessively rigid, the outer cylindrical pump casing is not required to have a thickness greater than that necessary to withstand the internal pressure developed in the pump casing, and is not required to be reinforced by a special reinforcing member. With the inner casing having the liner portion which is prevented from being deformed, it is easy to maintain a clearance between the liner portion and the impeller. The inner casing may also be of a reduced thickness as it is free from loads due to external forces. Consequently, the inner casing may also be easily pressed to shape with high accuracy.

According to one aspect of the present invention, since the inner casing is supported by the canned motor in a spaced relationship to the outer cylindrical pump casing, vibration and noise of the canned motor are not transmitted to the outer cylindrical pump casing through the inner casing. This structure of the pump casing is suitable for prevention of propagation of vibration and noise of the canned motor.

According to another aspect of the present invention, the inner casing is spaced from all components which constitute a pump casing separating internal surroundings in which a fluid to be pumped is contained, from external surroundings. Thus, even if external forces including an impact force are applied to the outer cylindrical pump casing, the resilient seal is effective to absorb deformations of the outer cylindrical pump casing. Hence, such deformations of the outer cylindrical pump casing are not transmitted to the inner casing. With the inner casing having the liner portion, it is easy to maintain a clearance between the liner portion and the impeller. Further, vibration and noise of the canned motor are not transmitted to the outer cylindrical pump casing through the inner casing.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
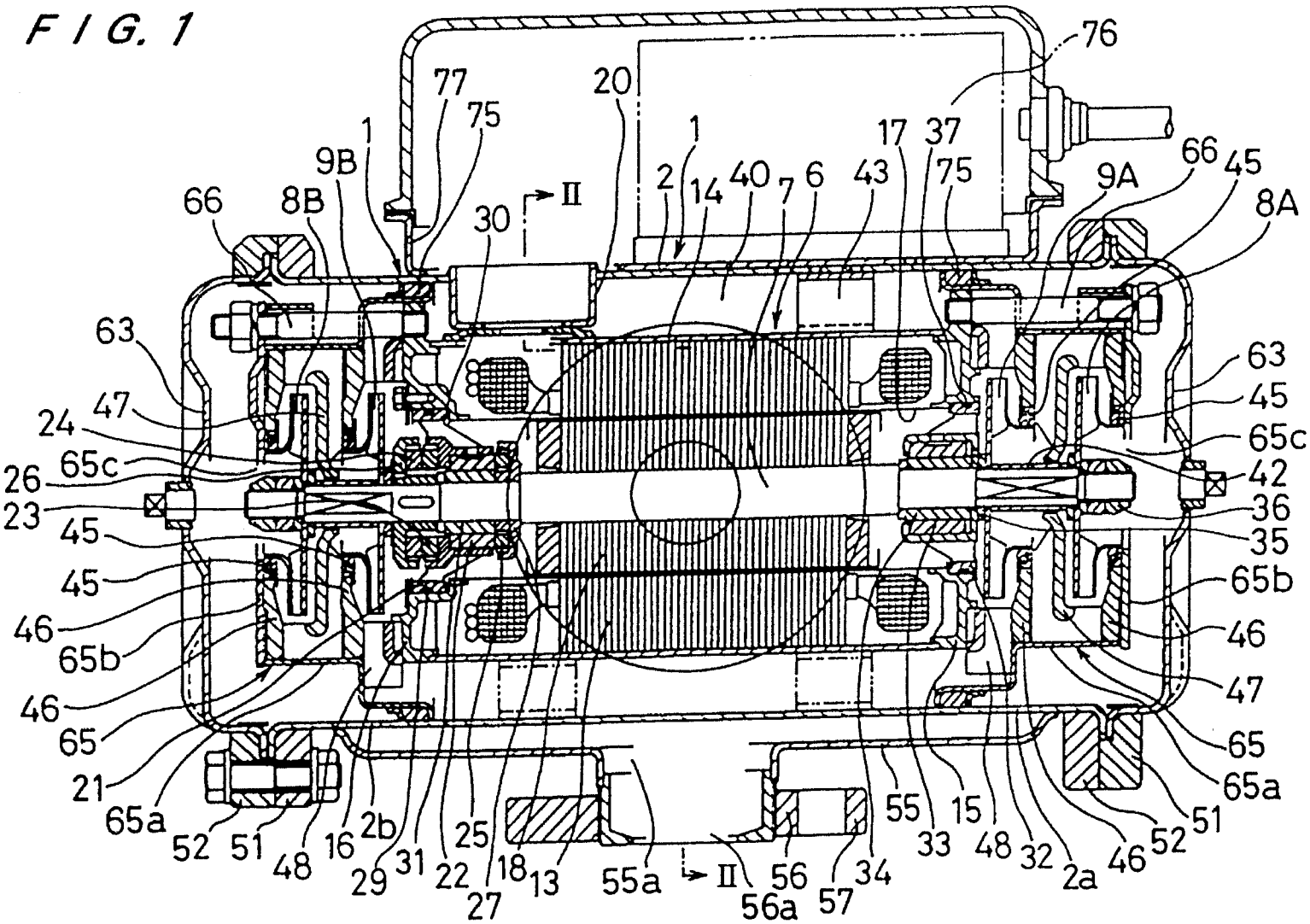
FIG. 1 is a cross-sectional view of a full-circumferential flow pump according to a first embodiment of the present invention.
Figure 2:
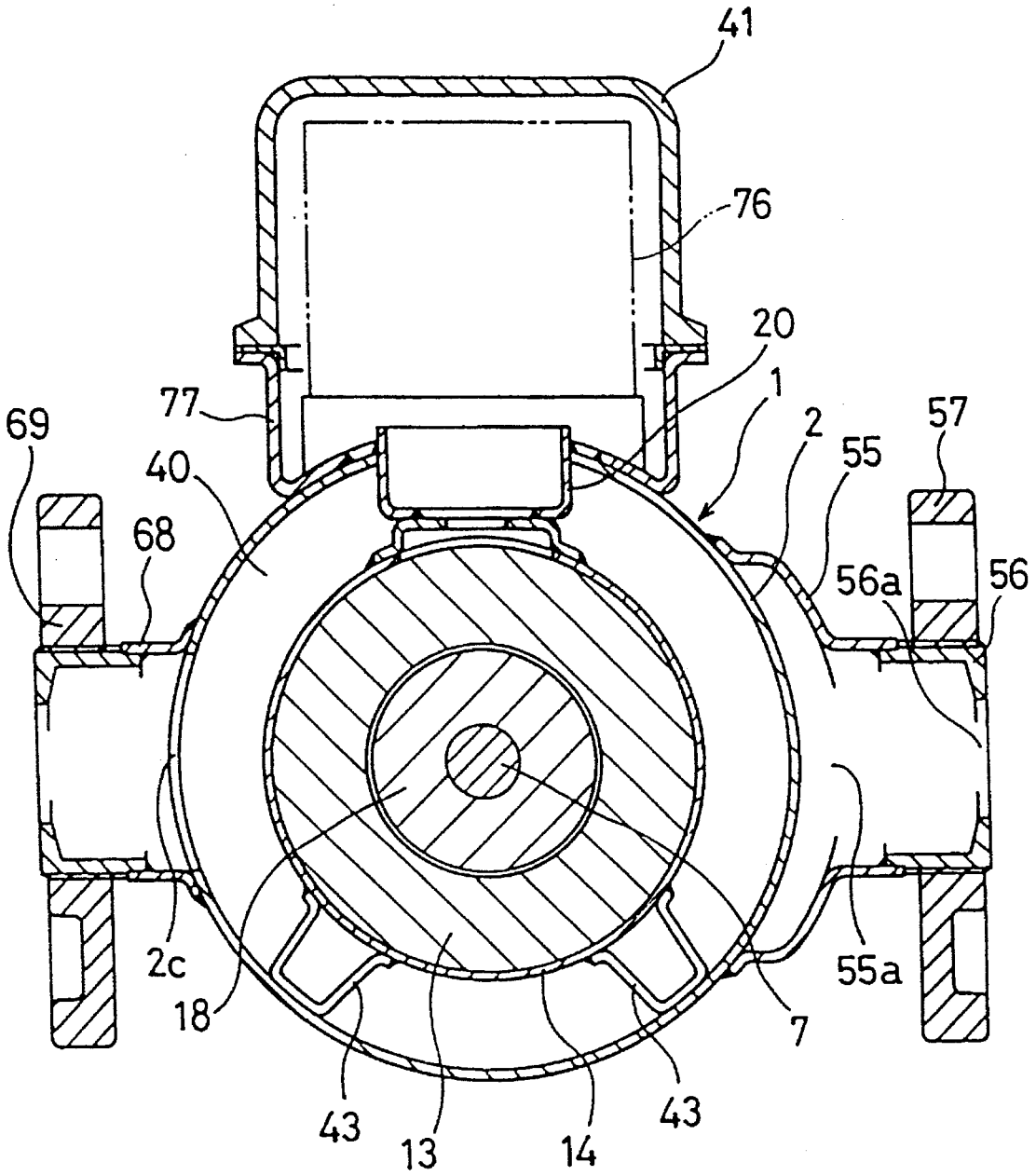
FIG. 2 is a cross-sectional view taken along line II—II of FIG. 1.

A full-circumferential flow pump according to the first embodiment of the present invention is shown in FIGS. 1 and 2. As shown in FIG. 1, the full-circumferential flow pump is of the double-suction type and has a canned motor 6 disposed centrally therein. The canned motor 6 includes a shaft 7 having opposite ends on which there are fixedly mounted respective pairs of impellers 8A, 9A and 8B, 9B each having an axially outwardly open suction mouth. Thus, two pump assemblies are disposed respectively on opposite sides of the canned motor 6. The canned motor 6 and the impellers 8A, 9A, 8B and 9B are housed in a pump casing 1 comprising an outer cylindrical pump casing 2 and a pair of spaced end covers 63 and 63. The end covers 63 are detachably fastened to the respective axial ends of the outer cylindrical pump casing 2 by respective flanges 51 and 52. The outer cylindrical pump casing 2 and the end covers 63 are made of sheet metal. The impellers 8A, 9A, 8B and 9B have blades made of sheet metal.

The canned motor 6 comprises a stator 13, a substantially cylindrical outer frame barrel 14 which encloses the stator 13, a pair of axially spaced side frame members 15 and 16 attached respectively to axial open ends of the outer frame barrel 14, and a cylindrical can 17 which is fitted in the stator 13 and welded to the side frame members 15 and 16. A rotor 18 which is rotatably housed in the stator 13 is supported on the shaft 7. An annular space or annular fluid passage 40 is defined between the outer frame barrel 14 and the outer cylindrical pump casing 2. A terminal case 20 is welded to the outer frame barrel 14. The canned motor 6 and the outer cylindrical pump casing 2 are fixed to each other by the terminal case 20 and stays 43 interposed therebetween. A case 77 is welded to the outer cylindrical pump casing 2 to house a frequency converter 76 therein. Leads extend outwardly from motor coils in the outer frame barrel 14 through the terminal case 20 and are electrically connected to the frequency converter 76.

The outer cylindrical pump casing 2 has a pair of suction windows 2*a* and 2*b* defined therein near the respective axial ends, and a suction case 55 is mounted on an outer circumferential surface of the outer cylindrical pump casing 2 so as to connect the suction windows 2*a* and 2*b* to each other. The suction case 55 is a substantially rectangular cup-shaped case having a bottom on one end and an opening on the other end. The suction case 55 is formed with a suction opening 55*a* for introducing a fluid therethrough. A suction nozzle 56 with a suction port 56*a* defined therein is fixedly mounted on the suction case 55 around the suction opening 55*a*. A suction flange 57 is mounted on the suction nozzle 56.

As shown in FIG. 1, two axially spaced inner casings 65 are disposed in the outer cylindrical pump casing 2 to house the respective pairs of impellers 8A, 9A and 8B, 9B. The inner casings 65 comprise a cylindrical member 65*a* and a cover 65*b* which covers an open end of the cylindrical member 65*a*, respectively, and are in the form of a cylindrical receptacle. The inner casings 65 have respective axial openings in which respective seal members 75 of a resilient material such as rubber are secured, and include respective bottoms with suction openings 65*c* defined respectively therein.

The seal members 75 serve to prevent a pumped fluid discharged from the impellers 9A and 9B from leaking toward the suction-side of the impellers 8A and 8B, respectively. The inner casings 65 are fixed to the side frame members 15 and 16 by bolts 66, respectively. In each of the inner casings 65, there are provided two retainers 46 having respective liner rings 45, a return blade 47 for guiding a fluid from the first-stage impeller 8A or 8B to the second-stage impeller 9A or 9B, and a guide device 48 for guiding a fluid discharged from the second-stage impeller 9A or 9B toward the annular space 40.

As shown in FIGS. 1 and 2, the annular space 40 is defined between the outer cylindrical pump casing 2 and the motor frame barrel 14. The outer cylindrical pump casing 2 has a discharge opening 2*c* defined in its circumferential wall and held in communication with the annular space 40. A discharge nozzle 68 with a discharge port 68*a* defined therein is fixedly mounted on the outer cylindrical pump casing 2 around the discharge opening 2*c*, and a discharge flange 69 is fixedly mounted on the discharge nozzle 68.

A bearing housing 21 is detachably fixed to the side frame member 16 with a resilient O-ring 29 being interposed between the bearing housing 21 and the side frame member 16. The bearing housing 21 and the side frame member 16 are joined to each other by a socket-and-spigot joint with a clearance fit with the O-ring 29 disposed therein. The bearing housing 21 is also prevented from being axially dislodged from the side frame member 16 by a plate fixed to the side frame member 16. A resilient member 30 such as rubber is disposed in an axial gap between the bearing housing 21 and the side frame member 16. The bearing housing 21 supports a radial bearing 22 on its radially inner surface and a stationary thrust bearing 23 on its axially outer surface. A shaft sleeve 31 fitted over the shaft 7 is rotatably supported by the radial bearing 22.

Two thrust disks 26 and 27 are fixedly mounted on the shaft 7 for axially sandwiching the bearing housing 21. The thrust disk 26 holds a thrust bearing 24 rotatable with the shaft 7 and facing an axially outer end surface of the stationary thrust bearing 23. The thrust disk 27 holds a thrust bearing 25 rotatable with the shaft 7 and facing an axially inner end surface of the radial bearing 22 which provides a stationary thrust sliding surface.

A bearing housing 32 is detachably fixed to the side frame member 15 with a resilient O-ring 37 being interposed between the bearing housing 32 and the side frame member 15. The bearing housing 32 holds a radial bearing 33 on the radially inner end. A shaft sleeve 34 fitted over the shaft 7 is rotatably supported by the radial bearing 33. The sleeve 34 contacts a washer 35 which is fixed to the shaft 7 through the impeller 9A, a sleeve 42 and the impeller 8A by double nuts 36.

Operation of the full-circumferential flow double-suction pump in FIGS. 1 and 2 will be described below.

The fluid which is drawn in through the suction port 56*a* and the suction opening 55*a* is divided by the suction case 55 into two fluid flows which are introduced into the pump assemblies through the suction windows 2*a* and 2*b*. The fluid flows pass through the suction openings 65*c* into the inner casings 65, and then are introduced to the impellers 8A and 8B, respectively. The fluid discharged from the impellers 8A and 8B flows to the impellers 9A and 9B, respectively. The fluid discharged from the impellers 9A and 9B is guided by the guide devices 48 and introduced into the annular space or passage 40 defined between the outer cylindrical pump casing 2 and the motor frame barrel 14. The fluid flows passing through the annular passage 40 merge in the middle of the annular passage 40, and then are discharged through the discharge opening 2*c* of the outer cylindrical pump casing 2 and the discharge nozzle 68 from the discharge port 68*a*.

In the above embodiment, the outer cylindrical pump casing 2 and the inner casings 65 are sealed from each other by the seal members 75 across which the differential pressure between the suction and discharge pressures is applied. Since the seal members 75 are effective to absorb deformations of the outer cylindrical pump casing 2, such deformations of the outer cylindrical pump casing 2 are not transmitted to the inner casings 65. Therefore, each of the inner casings 65 is not substantially deformed, and a clearance is maintained between each of the liner rings 45 and each of the impellers 8A, 8B, 9A and 9B for keeping each of the liner rings 45 out of contact with each of the impellers 8A, 8B, 9A and 9B.

Since the inner casings 65 are supported by the canned motor 6 in a spaced relationship to the outer cylindrical pump casing 2 and the covers 63, vibration and noise of the canned motor 6 is not transmitted to the outer cylindrical pump casing 2 and the covers 63 through the inner casings 65. This structure of the pump casing is suitable for prevention of propagation of vibration and noise of the canned motor 6.

Figure 3:
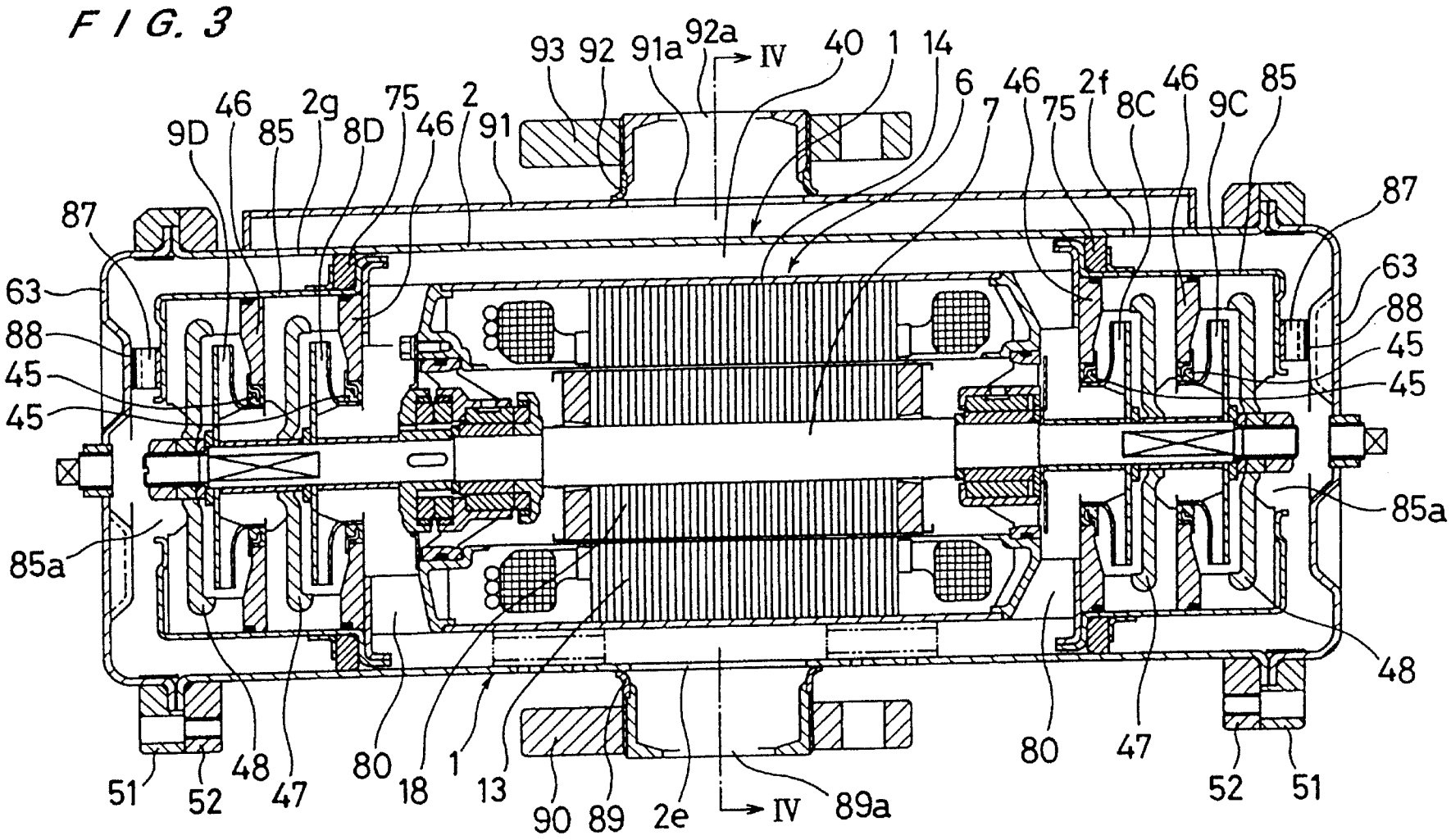
FIG. 3 is a cross-sectional view of a full-circumferential flow pump according to a second embodiment of the present invention.
Figure 4:
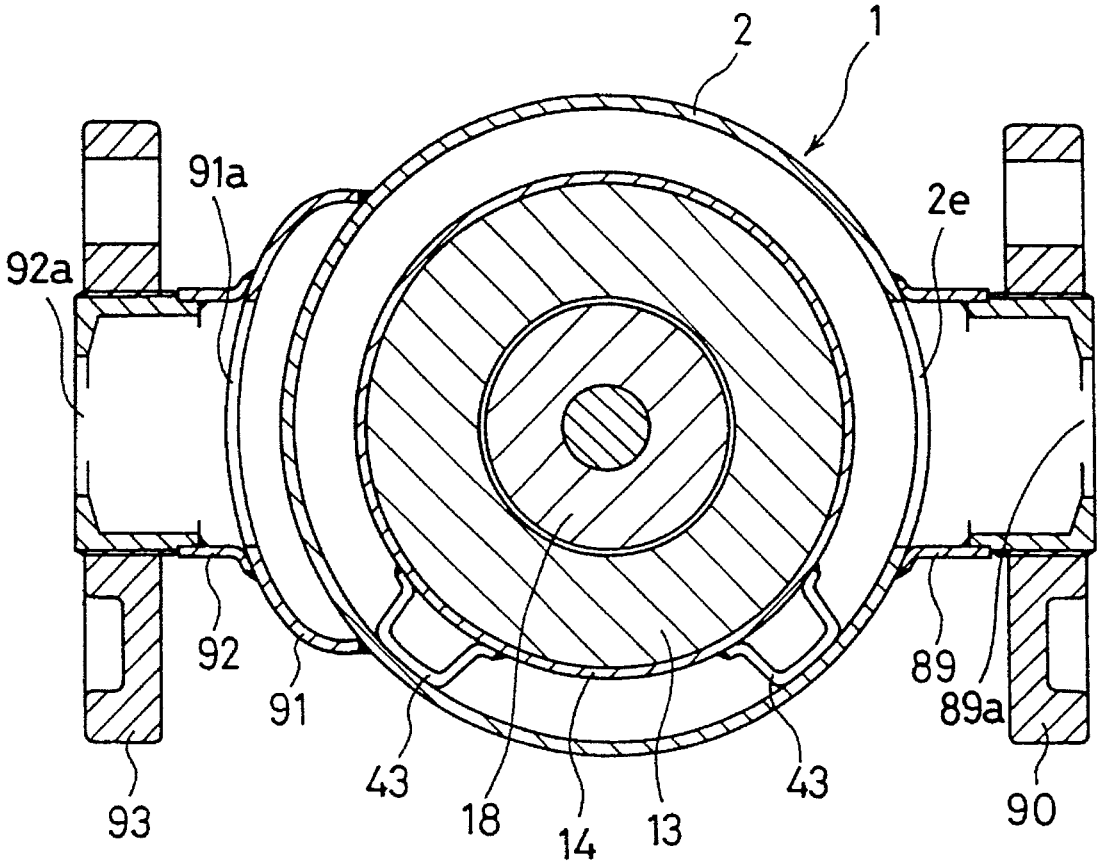
FIG. 4 is a cross-sectional view taken along line IV—IV of FIG. 3.

FIGS. 3 and 4 show a full-circumferential flow pump according to the second embodiment of the present invention. The full-circumferential flow pump according to the second embodiment is of the double-suction type and is essentially the same as the full-circumferential flow pump according to the first embodiment which is illustrated in FIGS. 1 and 2. Those parts shown in FIGS. 3 and 4 which are identical to those shown in FIGS. 1 and 2 are denoted by identical reference numerals, and will not be described in detail below.

According to the second embodiment, as shown in FIGS. 3 and 4, the full-circumferential flow pump has a canned motor 6 disposed centrally therein. The canned motor 6 includes a shaft 7 having opposite ends on which there are fixedly mounted respective pairs of impellers 8C, 9C and 8D, 9D each having an axially inwardly open suction mouth. Thus, two pump assemblies are disposed respectively on opposite sides of the canned motor 6. The canned motor 6 and the impellers 8C, 9C and 8D, 9D are housed in a pump casing 1 comprising an outer cylindrical pump casing 2 made of sheet metal and a pair of spaced end covers 63 made of sheet metal. The end covers 63 are detachably fastened to respective axial ends of the outer cylindrical pump casing 2 by respective flanges 51 and 52. The impellers 8C, 9C and 8D, 9D have blades made of sheet metal.

The canned motor 6 has substantially the same structure as that of the first embodiment of FIG. 1, but additionally has guide members 80 which are attached to the side frame members 15 and 16, respectively and have a radial flow passage. Inner casings 85 housing the impellers 8C, 9C and 8D, 9D comprise an integral cylindrical-cup shaped member, respectively. The inner casings 85 are fitted over the guide members 80, respectively. The inner casings 85 have respective axial openings in which respective seal members 75 of a resilient material such as rubber are secured, and include respective bottoms with discharge openings 85*a* defined respectively therein. The seal members 75 serve to prevent a pumped fluid discharged from the impellers 9C and 9D from leaking toward the suction-side of the impellers 8C and 8D, respectively. A stay 87 is interposed between each of the inner casings 85 and each of the covers 63. A resilient material 88 made of sheet-like rubber is interposed between the stay 87 and the cover 63. In each of the inner casings 85, there are provided two retainers 46 having respective liner rings 45, a return blade 47 for guiding a fluid from the first-stage impeller 8C or 8D to the second-stage impeller 9C or 9D, and a return blade 48 for guiding a fluid discharged from the second-stage impeller 9C or 9D toward the discharge opening 85*a*. The outer cylindrical pump casing 2 has a suction opening 2*e* at the central portion thereof, and a suction nozzle 89 with a suction port 89*a* fixedly mounted on the outer cylindrical pump casing 2 around the suction opening 2*e*. A suction flange 90 is fixedly mounted on the suction nozzle 89.

The outer cylindrical pump casing 2 has a pair of discharge windows 2*f* and 2*g* defined therein near the respective axial ends, and a discharge case 91 is mounted on an outer circumferential surface of the outer cylindrical pump casing 2 so as to connect the discharge windows 2*f* and 2*g* to each other. The discharge case 91 is a substantially rectangular cup-shaped case having a bottom on one end and an opening on the other end. The discharge case 91 is formed with a discharge opening 91*a*. A discharge nozzle 92 with a discharge port 92*a* defined therein is fixedly mounted on the discharge case 91 around the discharge opening 91*a*. A discharge flange 93 is mounted on the discharge nozzle 92. Other components of the pump in FIGS. 3 and 4 are the same as those of the pump in FIGS. 1 and 2.

Operation of the full-circumferential flow double-suction pump in FIGS. 3 and 4 will be described below.

The fluid which is drawn in through the suction opening 2*e* is divided by the annular passage 40 into two fluid flows which are introduced into the pump assemblies through the guide members 80. The fluid flows passing through the guide members 80 are introduced into the impellers 8C and 8D, respectively. The fluid discharged from the impellers 8C and 8D flows into the impellers 9C and 9D through the return blades 47, respectively. The fluid discharged from the impellers 9C and 9D passes through the return blades 48 and then flows through the openings 85*a* of the inner casings 85 and the discharge windows 2*f* and 2*g* into the discharge case 91. The fluid flows which have passed through the discharge windows 2*f* and 2*g* merge in the discharge case 91. Thereafter, the fluid is discharged through the discharge opening 91*a* of the discharge case 91 from the discharge port 92*a* of the discharge nozzle 92.

In the above embodiment, the outer cylindrical pump casing 2 and the inner casings 85 are sealed from each other by the seal members 75 across which the differential pressure between the suction and discharge pressures is applied. Since the seal members 75 are effective to absorb deformations of the outer cylindrical pump casing 2, such deformations of the outer cylindrical pump casing 2 are not transmitted to the inner casings 85. Therefore, each of the inner casings 85 is not substantially deformed, and a clearance is maintained between each of the liner rings 45 and each of the impellers 8C, 8D, 9C and 9D for keeping each of the liner rings 45 out of contact with each of the impellers 8C, 8D, 9C and 9D.

Since the inner casings 85 do not contact the outer cylindrical pump casing 2 and the covers 63 directly due to the presence of the seal members 75 and the resilient materials 88, vibration and noise of the canned motor 6 is not transmitted to the outer cylindrical pump casing 2 and the covers 63 through the inner casings 65. This structure of the pump casing is suitable for prevention of propagation of vibration and noise of the canned motor 6.

According to the present invention, the outer cylindrical pump casing is not required to be excessively rigid, the outer cylindrical pump casing is not required to have a thickness greater than that necessary to withstand the internal pressure developed in the pump casing, and is not required to be reinforced by a special reinforcing member. Therefore, it is easy to press form the pump casing to shape, thus improving production of the pump casing while maintaining a relatively small number of parts of the pump casing.

According to the present invention, since the inner casing for accommodating the guide device is provided, the shape of the outer cylindrical pump casing is not influenced by the guide device for obtaining a desired hydrodynamic performance, thus enabling the outer cylindrical pump casing to be a simple structure. Further, it is not necessary to ensure concentricity of the outer cylindrical pump casing and to very accurately machine the outer cylindrical pump casing.

According to the present invention, the inner casing may also be of a small thickness as it is free from loads due to external forces. Consequently, the inner casing may be also easily pressed to shape with high accuracy and may be made of plastics.

Although certain preferred embodiments of the present invention have been shown and described in detail, it should be understood that various changes and modifications may be made therein without departing from the scope of the appended claims.

What is claimed is:

1. A full-circumferential flow pump comprising:

a motor having a stator, a shaft, a rotor mounted on said shaft and positioned in said stator for rotation relative to said stator, and an outer frame barrel enclosing said stator;

an outer cylindrical pump casing positioned around said outer frame barrel, an annular space defined between said outer cylindrical pump casing and said outer frame barrel;

a pump assembly having at least one impeller mounted on an end of said shaft for one of pumping a fluid into said annular space and pumping a fluid from said annular space;

an inner casing provided in said outer cylindrical pump casing, said impeller provided in said inner casing;

a resilient seal located between said outer cylindrical pump casing and said inner casing to prevent a pumped fluid in said outer cylindrical pump casing from leaking towards a suction side of said impeller; and a suction case mounted on an outer circumferential surface of said outer cylindrical pump casing and having a suction opening defined therein for introducing a fluid therethrough;

wherein said outer cylindrical pump casing has a suction window for introducing a fluid therethrough, and a fluid to be pumped is introduced through said suction opening of said suction case and said suction window of said outer cylindrical pump casing into said pump assembly.

2. The full-circumferential flow pump according to claim 1, wherein said inner casing is spaced from said outer cylindrical pump casing.

3. The full-circumferential flow pump according to claim 1, wherein said outer casing encloses a region in which a fluid to be pumped is contained, and wherein said inner casing is spaced from said outer casing.

4. The full-circumferential flow pump according to claim 1, wherein said outer cylindrical pump casing is made of sheet metal.

5. The full-circumferential flow pump according to claim 1, further comprising an end cover which is fixed to an axial end of said outer cylindrical pump casing, said end cover being made of sheet metal.

6. The full-circumferential flow pump according to claim 1, wherein said motor has a side frame member fixed to an axial end of said outer frame barrel, and said inner casing is supported by said side frame member.

7. The full-circumferential flow pump according to claim 1, wherein said inner casing supports a liner ring extending around said impeller with a clearance defined between said impeller and said inner casing.

8. A full-circumferential flow pump comprising:

a motor having a stator, a shaft, a rotor mounted on said shaft and positioned in said stator for rotation relative to said stator, and an outer frame barrel enclosing said stator;

an outer cylindrical pump casing positioned around said outer frame barrel, an annular space defined between said outer cylindrical pump casing and said outer frame barrel;

a pump assembly having at least one impeller mounted on an end of said shaft for one of pumping a fluid into said annular space and pumping a fluid from said annular space;

an inner casing provided in said outer cylindrical pump casing, said impeller provided in said inner casing, said outer casing enclosing a region in which a fluid to be pumped is contained, said inner casing being spaced from said outer casing; and a suction case mounted on an outer circumferential surface of said outer cylindrical pump casing and having a suction opening defined therein for introducing a fluid therethrough;

wherein said outer cylindrical pump casing has a suction window for introducing a fluid therethrough, and a fluid to be pumped is introduced through said suction opening of said suction case and said suction window of said outer cylindrical pump casing into said pump assembly.

9. The full-circumferential flow pump according to claim 8, wherein said outer cylindrical pump casing is made of sheet metal.

10. The full-circumferential flow pump according to claim , further comprising an end cover fixed to an axial end of said outer cylindrical pump casing, said end cover being made of sheet metal.

11. The full-circumferential flow pump according to claim 8, wherein said motor has a side frame member fixed to an axial end of said outer frame barrel, and said inner casing is supported by said side frame member.

12. The full-circumferential flow pump according to claim 8, wherein said inner casing supports a liner ring extending around said impeller with a clearance defined between said impeller and said inner casing.

13. A full-circumferential flow pump comprising:

a motor having a stator, a shaft, a rotor mounted on said shaft and positioned in said stator for rotation relative to said stator, and an outer frame barrel enclosing said stator;

an outer cylindrical pump casing positioned around said outer frame barrel, an annular space defined between said outer cylindrical pump casing and said outer frame barrel;

a pump assembly having at least one impeller mounted on an end of said shaft for one of pumping a fluid into said annular space and pumping a fluid from said annular space;

an inner casing provided in said outer cylindrical pump casing, said impeller provided in said inner casing;

a resilient seal located between said outer cylindrical pump casing and said inner casing to prevent a pumped fluid in said outer cylindrical pump casing from leaking towards a suction side of said impeller; and a discharge case mounted on an outer circumferential surface of said outer cylindrical pump casing and having a discharge opening defined therein for discharging a fluid therethrough;

wherein said outer cylindrical pump casing has a discharge window for discharging a fluid therethrough, and a pumped fluid from said pump assembly is discharged through said discharge window of said outer cylindrical casing and said discharge opening of said discharge case.

14. A full-circumferential flow pump comprising:

a motor having a stator, a shaft, a rotor mounted on said shaft and positioned in said stator for rotation relative to said stator, and an outer frame barrel enclosing said stator;

an outer cylindrical pump casing positioned around said outer frame barrel, an annular space defined between said outer cylindrical pump casing and said outer frame barrel;

a pump assembly having at least one impeller mounted on an end of said shaft for one of pumping a fluid into said annular space and pumping a fluid from said annular space;

an inner casing provided in said outer cylindrical pump casing, said impeller provided in said inner casing, said outer casing enclosing a region in which a fluid to be pumped is contained, said inner casing being spaced from said outer casing; and a discharge case mounted on an outer circumferential surface of said outer cylindrical pump casing and having a discharge opening defined therein for discharging a fluid therethrough;

wherein said outer cylindrical pump casing has a discharge window for discharging a fluid therethrough, and a pumped fluid from said pump assembly is discharged through said discharge window of said outer cylindrical casing and said discharge opening of said discharge case.

* * * * *

UNITED STATES PATENT AND TRADEMARK OFFICE

CERTIFICATE OF CORRECTION

PATENT NO. : 5,616,013

DATED : APRIL 1, 1997

INVENTOR(S) : MAKOTO KOBAYASHI ET AL

It is certified that error appears in the above-indentified patent and that said Letters Patent is hereby corrected as shown below:

IN THE CLAIMS

Column 8, line 42, please change "claim ," to

--claim 8,--.

Signed and Sealed this

Fourteenth Day of October, 1997

*Attest:*

*Attesting Officer*

BRUCE LEHMAN

*Commissioner of Patents and Trademarks*